United States Patent [19]

Barrett

[11] 4,033,412

[45] July 5, 1977

[54] FLUID CARRIER RECOVERY SYSTEM AND METHOD

[76] Inventor: George M. Barrett, R.R. No. 5, Galt, Ontario, Canada

[22] Filed: June 18, 1976

[21] Appl. No.: 697,447

[52] U.S. Cl. ..... 166/267; 166/305 R; 166/67

[51] Int. Cl.[2] ..... E21B 43/12; E21B 43/22; E21B 39/00

[58] Field of Search ..... 166/303, 305 R, 267, 166/265, 314, 268, 306, 67, 75

[56] References Cited

UNITED STATES PATENTS

| | | | |
|---|---|---|---|
| 2,882,973 | 4/1959 | Doscher et al. | 166/305 R X |
| 3,057,404 | 10/1962 | Bergstrom | 166/267 |
| 3,157,231 | 11/1964 | Darley | 166/268 |
| 3,730,270 | 5/1973 | Allred | 166/303 X |
| 3,779,602 | 12/1973 | Beard et al. | 166/303 X |
| 3,811,506 | 5/1974 | Carlin | 166/305 R X |
| 3,894,769 | 7/1975 | Tham et al. | 166/305 R X |
| 3,913,672 | 10/1975 | Allen et al. | 166/305 R X |
| 3,978,926 | 9/1976 | Allen | 166/305 R X |

*Primary Examiner*—Novosad Stephen J.
*Attorney, Agent, or Firm*—Diller, Brown, Ramik & Wight

[57] ABSTRACT

This disclosure relates to a fluid carrier recovery system for recovering oil and like liquid deposits from an underground source wherein the oil is deposited in an unpumpable form and wherein the oil is recovered by directing into the oil deposit a carrier which will fill a large volume of the oil deposit and which will flow upwardly through a flow passage in the earth to a location adjacent or above the surface of the earth, followed by the introduction into the lower part of such volume of a solvent for the oil, the solvent having a lesser specific gravity than the carrier and being operative on the oil to form oil-solvent droplets which float in the carrier and flow to the top of the flow passage for recovery. The carrier is preferably water and the solvent may be an inexpensive mineral spirit immiscible with water.

12 Claims, 1 Drawing Figure

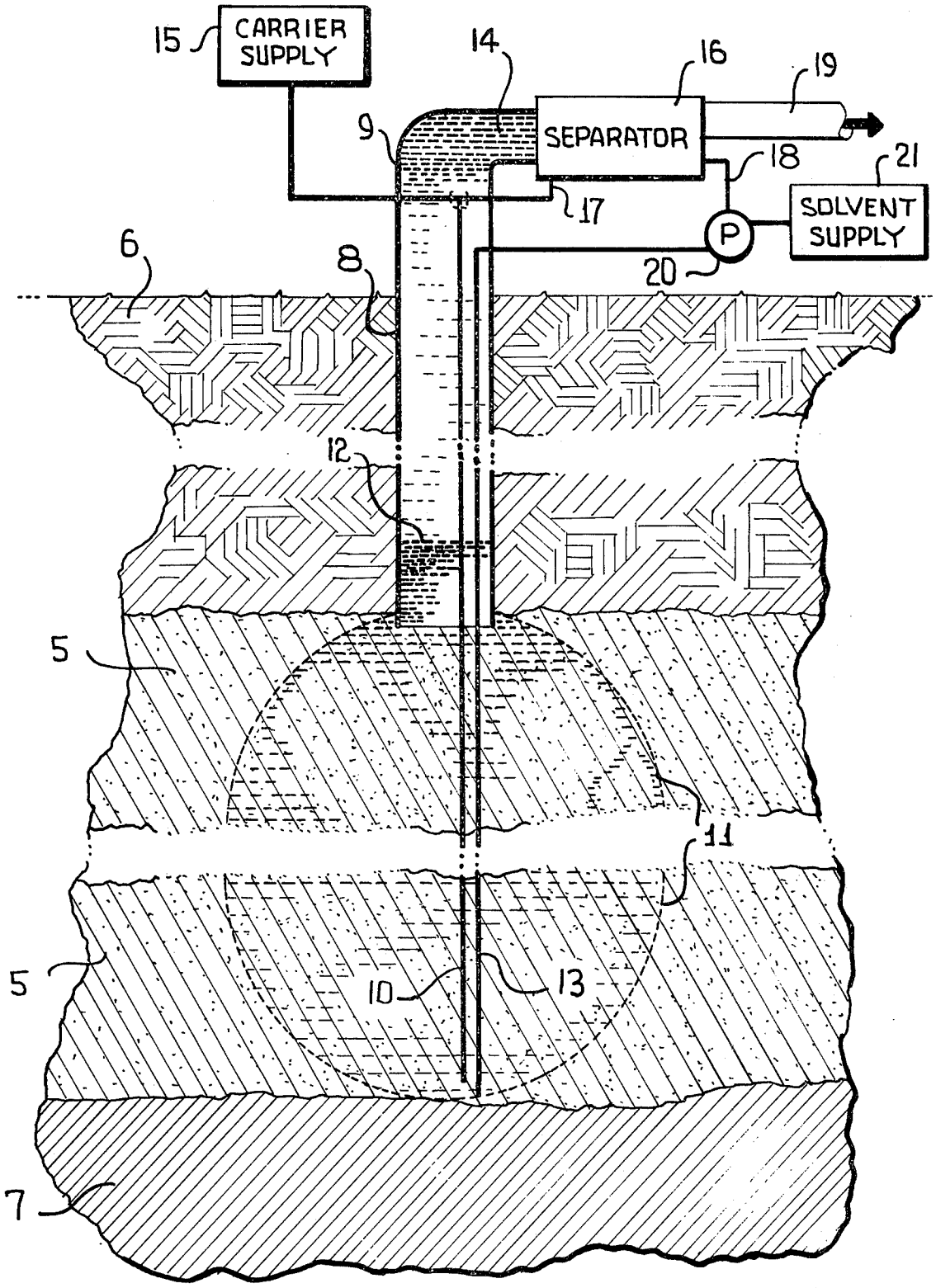
CARRIER SUPPLY
SEPARATOR
SOLVENT SUPPLY
P
15
14
16
19
9
18
21
17
6
8
20
12
5
11
5
10
13
7

FLUID CARRIER RECOVERY SYSTEM AND METHOD

This invention relates in general to a new and useful fluid carrier recovery system for recovering oil and the like from an underground source wherein the oil is deposited in an unpumpable form.

It is well known that there are very large deposits of tar sand in Canada the recovery of which to date is not economically feasible. In a like manner there are very large deposits in the United States of oil shale wherein the recovery of the oil is not economically feasible. In addition the processes which have been developed to date for recovering oil from tar sand and oil shale have pollution problems.

As will be described hereinafter, there has been developed a recovery system particularly adapted for recovering oil from tar sand and which system in a like manner is operable for removing oil from oil shale or coal deposits.

An attempt has been made to remove oil from tar sand by pumping a solvent into the tar sand. The introduction of the solvent into the tar sand has changed the constituency of the tar sand from a very heavy, very thick unpumpable material to a less heavy, less thick, but still unpumpable, material with the loss of large volumes of solvent. The problem has been not that the solvent does not thin the oil so that it can be removed from the sand, but that there is nothing to induce flow of the oil-solvent mixture or solution out of the sand. The sand remains part of the mixture and cannot be pumped from the surface.

Further, even if it were possible to add sufficient solvent to the tar sand so as to obtain a pumpable mixture, this would be uneconomical for several reasons. First of all, the volume of the sand constitues approximately 90% of the tar sand. Secondly, sand is very abrasive and the wear and tear on equipment would be prohibitive. Thirdly, there must be some disposal of the sand. In the areas where the tar sand exists, there is no need for the sand. On the other hand, it is virtually impossible to return the sand underground generally to its point of origin.

In accordance with this invention, the problem of separating the oil-solvent mixture or solution from the sand has been extremely simplified. A suitable carrier, such as water, is pumped into the tar sand in sufficient volume that the water fills the cavities in the tar sand and further flows back up to or substantially adjacent the surface of the earth through a flow passage in the earth down to the tar sand deposit. Then when a suitable solvent is introduced into the tar sand, the solvent dilutes the oil to the extent that dropplets of oil-solvent mixture or solution are released from the sand and these droplets float in the carrier up to the earth's surface through the flow passage. The oil is thus separated from the sand in situ so that the sand need not be handled at all. Further, because the oil-solvent mixture or solution freely floats upwardly within the carrier to above the surface of the carrier, no pumping of the oil-solvent mixture or solution per se is required. Basically, all that is required is that sufficient volumes of the carrier (water) is flowed underground to maintain a carrier level within the flow passage above which it is desired to have the oil-solvent mixture or solution float for recovery purposes and to continuously supply sufficient quantities of solvent to effect a reduction in the viscosity of the oil so that it will free itself from the sand and float in the carrier.

The manner in which these and other objects of this invention is attained will be made clear by consideration of the following specification and claims when taken in conjunction with the single drawing which is a schematic fragmentary sectional view taken through the earth showing the specific details of the fluid carrier recovery system.

Referring now to the drawing in detail, it will be seen that there is illustrated a typical sectional view, with parts broken away, of the earth wherein there is deposited oil in an unpumpable form. A typical tar sand deposit, generally identified by the numeral 5, is disposed below the surface of the earth and has disposed in overlying relation thereto an overburden 6. The overburden will in most instances have a thickness of 500 feet or greater. In a like manner, the tar sand layer may have a thickness on the order of 500 feet or greater. Below the tar sand layer 5 is an underburden 7 which in many instances is in the form of rock. The underburden normally forms a seal below the tar sand layer.

In accordance with this invention, a flow passage 8 is formed from the earth surface down through the overburden 6 into the upper part of the tar sand layer 5. Depending upon the nature of the overburden 6, the flow passage 8 may be, for the most part, a drilled hole although the upper part thereof will be provided with a casing 9. The casing 9, if it is required to extend down through the overburden 6, will extend into the tar sand layer 5 only a relatively short distance.

A carrier supply pipe 10 is directed down into the earth to a position somewhat near the bottom of the tar sand layer 5. The carrier supply pipe 10, for convenience purposes, may extend down through the flow passage 8. It is to be understood that due to the relatively great head of the carrier within the carrier supply pipe 10, for all practical purposes, no pumping of the carrier is required. However, the pressure of the carrier at the bottom of the carrier supply pipe 10 will be very high and sufficient to permit the flow of the carrier into a large volume of the tar sand, this volume being generally outlined by dotted lines and identified by the numeral 11. The volume of the carrier directed through the carrier supply pipe 10 will be such not only to fill the volume 11 with the carrier, but also to fill the flow passage 8 with the carrier to a relatively high level, such as the carrier level 12.

A solvent supply pipe 13 is also directed into the earth and terminates within the volume 11 substantially at the bottom of the tar sand layer 5. The solvent supply pipe 13 may also pass down through the flow passage 8 although it may be separately installed.

It is to be understood that the solvent delivered to the bottom of the volume 11 through the solvent supply pipe 13 will be distributed within the volume 11 and due to the fact that it is of a lower specific gravity than the carrier, the solvent will float upwardly within the volume 11 and in doing so will form in combination with the oil, oil-solvent droplets which will separate from the sand and float upwardly within the volume 11 due to the fact that the oil-solvent droplets have a specific gravity less than that of the carrier. The oil-solvent droplets will migrate toward the flow pasage 8 and up through the flow passage 8 to form an oil-solvent supply 14 above the carrier level 12.

At this time it is pointed out that the most feasible carrier will be water. However, the specific gravity of the water may be raised by adding thereto conventional salt so that, depending upon the availability of salt, the carrier will be either water or a salt-water solution. The carrier will be supplied to the carrier supply pipe 10 from a carrier supply 15 with the carrier flow being primarily gravitational.

The solvent must have a specific gravity less than that of the carrier. It is also preferred that the solvent not be miscible with the carrier. It has been found that the preferred solvents, from a standpoint of economy, should be mineral spirits and hydrocarbons. Conventional solvents such as "VARSOL" naphtha, lacquer thinner, toluene, butane, methane, benzene and propane may be utilized. Also, hydrogen may be utilized as a solvent. It is to be understood that butane, methane, hydrogen and propane will be liquids at the pressures involved.

It is to be understood that a single solvent may be utilized although it is desired that a mixture of several solvents be used in that different constituents of the oil more readily pass into solution with different solvents.

It is also to be understood that the specific gravity of an average solvent is on the order of 0.6 and that the specific gravity of the oil-solvent droplet is on the order of 0.9. Therefore, the carrier should have a specific gravity greater than 0.9 which makes water, with a specific gravity of 1.0, a satisfactory carrier. However, the greater the differential between the specific gravity of the oil-solvent droplets and that of the carrier, the greater the rate of flow of such droplets towards the surface. It is for this reason that it may be desired to increase the specific gravity of water, when utilized as a carrier, by the addition of salt or other materials which will readily go into solution with water so as to increase the specific gravity thereof.

It is to be understood that while the flow collected from the upper end of the flow passage 8 will be primarily an oil-solvent solution or mixture, the collected liquid will also include a certain amount of the carrier. These are passed into a conventional type of separator 16 which functions to remove the carrier at 17, solvent at 18 and oil at 19. While the collected carrier will flow back down through the carrier supply pipe 10 under gravity, due to the difference in specific gravity between the solvent and the carrier, it is necessary that the solvent be pumped down through the solvent supply pipe 13. Accordingly, the separated solvent will be passed through a pump 20.

It is also to be understood that an initial solvent supply is required and this is identified by the numeral 21. Pump 20 will be utilized to pump the initial solvent supply into the earth.

Further, it is to be understood that the oil in the tar sand naturally has a small percentage of the solvents. Thus rather than the solvent supply being depleted during the operation of the system, once the system is operating at a maximum, there will be a recovery of solvent which may be returned to the solvent supply 21.

It will be readily apparent that not only is the recovery system very economical, but also there is no pollution problem involved. First of all, the carrier supply will be a natural supply with it being feasible to even utilize ocean water. Secondly, none of the water which is directed into the ground is distributed on the surface. Not only is all of the separated water passing from the separator 16 returnable into the ground, but as the oil is removed, it must be replaced by like volumes of water.

As pointed out above, for all practical purposes, the solvent is recirculated. However, the excess solvent is collected and is valuable. Of course, the collected oil is the product which is being recovered and is therefore salvaged in its entirety.

It is also to be recognized that the cost of operating the system is a minimum. No power, or practically no power, is required to place the carrier in the ground. Certain pumping power is required to place the solvent in the ground. It is also recognized that certain power is required to operate the separator. However, the required power is minimal and once the system is in operation, no outside power is required in that the recovered products may be utilized for powder purposes.

Although the recovery system has been primarily developed for use in recovering oil from tar sand, it will be apparent that wherever oil exists in an unpumpable state and yet removable as droplets by introducing thereinto a solvent, the recovery system is feasible. Particular reference is made here to the recovery of oil from oil shale or coal.

Although only a preferred embodiment of the invention has been specifically illustrated and described herein, it is to be understood that minor variations may be made in the recovery system without departing from the spirit and scope of the invention, as defined by the appended claims.

The embodiments of the invention in which an exclusive property or privilege is claimed are defined as follows:

1. A method of recovering oil and the like from an underground source wherein the oil is deposited in an unpumpable form, said method comprising the steps of providing a flow passage down to an upper part of the oil deposit, flowing a liquid carrier into the oil deposit generally in alignment with and below said flow passage until a large volume of the oil deposit below the flow passage is filled with the carrier and the carrier reaches a predetermined level within the flow passage above the oil deposit, and then flowing a solvent for the oil into the volume of the oil deposit filled by the carrier, the solvent having a specific gravity less than the carrier and when combined with oil having a specific gravity less than the carrier whereby as mixtures of oil and solvent are formed the mixtures will float to the surface of the carrier within the flow passage for recovery.

2. The method of claim 1 wherein the solvent is directed into the lower part of the volume of oil deposit filled with the carrier for upward circulation through the oil deposit due to the relative specific gravities of the solvent and the carrier.

3. The method of claim 1 wherein the solvent is substantially immiscible with the carrier.

4. The method of claim 1 wherein the carrier is primarily water.

5. The method of claim 1 wherein the carrier is a mixture of water and means for increasing the specific gravity of water.

6. The method of claim 1 wherein the carrier is a mixture of water and salt wherein the specific gravity of the carrier is greater than 1.0.

7. The method of claim 1 wherein the solvent is a mixture of several solvents each being a solvent for a constituent of the oil to provide for maximum oil recovery.

8. The method of claim 1 wherein the solvent is a mineral based solvent as opposed to a vegetable based solvent.

9. The method of claim 1 wherein all products received from the flow passage fall in the categories of materials returned underground and usable retained materials.

10. Apparatus for recovering oil and the like from an underground source wherein oil is deposited in an unpumpable form, said apparatus comprising means for defining a flow passage generally from the surface of the earth to an upper portion of the source, carrier supply means for flowing a liquid carrier into a lower portion of the source generally in vertical alignment with the flow passage to fill a volume of the source and a major portion of said flow passage with a carrier, solvent supply means for directing a solvent into a lower portion of the volume, and collector means connected to the upper end of said flow passage for receiving an oil-solvent mixture floating on the carrier within said flow passage.

11. The apparatus of claim 10 wherein said collector means includes means for separating solvent from oil, and said solvent supply means includes means for recirculating at least a major portion of the separated solvent.

12. The apparatus of claim 10 wherein said collector means includes means for separating solvent, oil and carrier from one another, said carrier supply means including means for returning separated carrier, and said solvent supply means includes means for recirculating at least a major portion of the separated solvent.

* * * * *